US006622340B2

(12) United States Patent
Rosa

(10) Patent No.: US 6,622,340 B2
(45) Date of Patent: Sep. 23, 2003

(54) MULTI-POSITIONAL PAINT TRAY

(76) Inventor: Wallace B. Rosa, 265 Butts Rd., Morton, WA (US) 98356-9711

( * ) Notice: Subject to any disclaimer, the term of this patent is extended or adjusted under 35 U.S.C. 154(b) by 0 days.

(21) Appl. No.: 09/905,324

(22) Filed: Jul. 13, 2001

(65) Prior Publication Data

US 2002/0005409 A1 Jan. 17, 2002

Related U.S. Application Data

(60) Provisional application No. 60/218,671, filed on Jul. 14, 2000.

(51) Int. Cl.[7] ..... A47L 13/56

(52) U.S. Cl. ..... 15/257.06; 220/570; D32/53.1

(58) Field of Search ..... 15/257.01, 257.05, 15/257.06; 220/520; D32/53.1

(56) References Cited

U.S. PATENT DOCUMENTS 2,661,858 A * 12/1953 Howell
2,798,239 A * 7/1957 Freund
3,351,970 A 11/1967 Engh
3,625,388 A 12/1971 Golden
3,707,242 A 12/1972 Golden et al.
3,850,298 A * 11/1974 Jolly
4,023,702 A 5/1977 McKnight
4,102,468 A * 7/1978 Goldman
4,387,477 A * 6/1983 Eisenberg
4,706,918 A 11/1987 Wilson
5,201,439 A * 4/1993 Davies
5,400,916 A 3/1995 Weber
5,461,752 A 10/1995 Lemon et al.
5,493,751 A * 2/1996 Misiukowiec et al.
5,553,348 A 9/1996 Brandenburger
5,836,043 A 11/1998 Rovas
D461,288 S * 8/2002 Tennant

FOREIGN PATENT DOCUMENTS

GB 2358177 * 7/2001

* cited by examiner

*Primary Examiner*—Terrence R. Till
(74) *Attorney, Agent, or Firm*—Dean A. Craine

(57) ABSTRACT

A paint tray that can be used in the vertical as well as horizontal position to hold paint for use with a roller. Formed longitudinally inside the tray is an inclined bottom surface designed to return excess paint to the basin when the paint tray is disposed horizontally. Formed on the inclined surfaces is a plurality of parallel raised contact surfaces that provides a directional contact surface used to remove excess paint from the roller and return the excess paint to the basin. The length of the inclined surface is sufficient to create freeboard for use in the vertical position without risk of spillage. The paint tray is equipped with a pair of legs attached to its distal end that allows the paint tray to rest vertically on the rung(s) of a ladder or step(s) of a stepladder, or horizontally on the ladder shelf as traditional paint trays. Aligned longitudinally on the distal end of the paint tray is a rigid handle for easy transport of the paint tray in the vertical position. Also aligned longitudinally on the proximal end of the paint tray are a plurality of feet that enable the paint tray to stand vertically on a support surface.

18 Claims, 5 Drawing Sheets

MULTI-POSITIONAL PAINT TRAY

This is a utility patent application based on a provisional patent application (Serial No. 60/218,671) filed on Jul. 14, 2000.

BACKGROUND OF THE INVENTION

1. Field of the Invention

This invention pertains to paint trays, and, more particularly, to paint trays used with paint rollers.

2. Description of the Related Art

Paint trays are commonly used to apply paint to a surface using a paint roller. Typically, paint trays are an open pan-like structure with four upward extending side walls and an inclined bottom surface that recedes at one end to form a flat basin which is filled with a small amount of paint. Short legs are attached to the proximal end of the structure to elevate the proximal end of the bottom inclined surface relative to the basin so that paint deposited on the inclined surface automatically flows back to the basin when the tray is disposed in a horizontal position.

It is widely known that when painting with a paint roller, the user must frequently refill the paint tray. Standard paint trays have a working volume of approximately one pint of paint that is sufficient to cover approximately fifty square feet or about six running feet of a standard, eight foot high interior wall. It is also known that filled paint trays are notoriously unstable when filled with paint. Two hands and great care are needed to move the paint tray from one horizontal position to another to prevent spillage. The user must frequently return to the paint tray to re-apply fresh paint to the roller. Typically, the user dips the front edge of the roller into the paint located in the basin and then rolls the roller over the inclined surface to remove excessive paint and evenly distribute the paint around the roller.

Because the user must constantly re-apply fresh paint to the roller, it is normally desirable to carry or relocate the paint tray to the area being painted. When the paint tray is used while standing on a stepladder, two hands are normally used to lift the paint tray to a desired rung or shelf. Because most users need at least one hand to climb a stepladder, using standard paint trays while on a stepladder is generally regarded as unsafe.

U.S. Pat. No. 3,351,970 (Engh) discloses a paint tray designed to be used in both vertical and horizontal positions. The paint tray is similar to the typical paint tray described above but includes back and side walls that extend upward to form a larger, square-shaped basin and is designed to hold paint when the tray is positioned vertically. Two hook-shaped members are used as short legs to hold the paint tray on a ladder or to connect the paint tray to a shoulder strap. The paint tray also includes a longitudinally aligned, U-shaped bail or handle that pivotally connects to the sides of the tray which allows the paint tray to be carried with one hand. During use, the handle is pivoted between an extended, forward direction and a retracted, rearward direction when used vertically or horizontally, respectively.

One serious drawback with the paint tray disclosed in U.S. Pat. No. 3,351,970 is that the handle is not fixed on the paint tray, making it difficult for the user to hold the paint tray in a fixed, vertically disposed position when the paint roller is dipped into the basin and rolled over the inclined surface. When the roller is pressed against and rolled across the inclined surface while holding the handle, the body of the paint tray pivots and swings, preventing the user from completely unloading excessive paint or evenly distributing paint around the roller. The pivoting movement of the handle also increases the safety risk when the paint tray is used on a stepladder. When the paint tray is hooked onto a ladder rung, the handle must be swung underneath the body of the paint tray to prevent obstruction. When moving up or down the stepladder, the user must reach underneath the body of the paint tray and grasp the handle and swing it upward, causing the user to push his body far out from the ladder in an unbalanced and unsafe position. To move the paint tray from a vertical to a horizontal position when not used on a ladder, the user must use two hands and exercise skill and care, lest the paint tray suddenly drop into its reverse rest position, spilling paint.

The paint tray disclosed in U.S. Pat. No. 3,351,970 has additional drawbacks. First, the drain board creates a large dead space that is filled with paint, greatly lowering the paint tray effective volume, when it is disposed in a horizontal position. The body of the paint tray has sharp corners which also creates dead spaces. The existence of dead spaces in a paint tray is troublesome because the paint partly dries and forms a skin which may be transferred to the wall surface and makes cleaning more difficult.

A second drawback with such paint trays is that the hook members must be extended around the rungs of a stepladder. If the outer shape of the rungs and the hooks are not compatible, the paint tray cannot be safely attached to the rung. Unfortunately, no means is provided for safely engaging the surface of the rungs.

A drawback with all paint trays in the prior art is that the raised contact surfaces formed on the inclined surface on the paint tray do not adequately remove or evenly distribute excessive paint from the roller. The raised contact surfaces also do not remain in constant contact with the roller. Ideally, the raised contact surfaces should evenly apply pressure against the entire roller surface. The raised contact surfaces should also uniformly redirect any excessive paint removed from the roller to the basin. Unfortunately, the raised bumps and transversely aligned chevrons commonly used in the prior art have both of these drawbacks. What is needed is a paint tray with a fixed, rigid handle, such that it can be securely and firmly carried with a single hand; that can be used for painting while being so carried without ancillary attachments; that can be securely set in, or removed from, a resting position on any rung of a ladder or stepladder with a single, simple motion; that can be selectively used in either horizontal or vertical positions, alternating between positions by a single, one-handed motion, without adjustment of moving parts; all without risk of spillage of paint and without compromising the safety of the painter. The paint tray should hold at least one-half gallon of paint and have curved corners, eliminating the need for frequent refills and allowing all the paint in the paint tray to be accessible to the roller. The paint tray should be of a simple, single-piece design, easy to understand and use, and feasible to economically manufacture by various methods, to take advantage of the durability of metal, or the paint-shedding traits of some plastics.

SUMMARY OF THE INVENTION

It is an object of the present invention to provide a paint tray that may be used in a horizontal position or held in a vertical position by a rigid handle that allows the painter to dip the roller in the paint tray without causing unwanted rocking or swinging of the paint tray.

It is another object of the present invention to provide such a paint tray that safely holds approximately one gallon of paint with minimal dead spaces.

It is another object of the present invention to provide such a paint tray that includes raised contact surfaces on the inclined surface that evenly remove and distribute excessive paint from the roller and then return the excessive paint to the paint tray basin.

It is further object of the present invention to provide such a paint tray that uses improved legs capable of engaging the rungs on a ladder or stepladder.

It is a still further object of the present invention to provide such a paint tray that is economical to manufacture and ship.

These and other objects of the invention which will become apparent are met by a one-piece, large volume paint tray that can be used in a horizontal, as well as vertical, position to apply paint with a roller. Formed along the distal end of the paint tray is a partially enclosed basin that includes upward extending side walls, an end wall, and a top wall that extends to cover the basin. The corners between the end wall and the basin are curved thereby eliminating dead spaces so that a standard roller may pick up any paint located therein.

Formed longitudinally on the outer surface of the end wall is a pair of optional feet designed to hold the paint tray in an upright, vertically aligned position on a suitable support surface.

Formed on the body of the paint tray is a longitudinally aligned, inclined surface. The dimensions of the basin and the inclined surface are sufficient to provide sufficient freeboard when the paint tray is used in a vertical position. Formed on the top surface of the inclined surface is a plurality of raised zigzag-shaped contact surfaces. The zigzag-shaped contact surfaces provide a continuous surface over which a roller may be rolled to remove excess paint from the roller. The zigzag-shaped contact surfaces are also longitudinally aligned on the inclined surface so that excessive paint flows directly into the basin. In the preferred embodiment, the zigzag-shaped contact surfaces are aligned so that they do not have any overlapping edges. This assures that the same amount of pressure is applied to the roller surfaces when rolled across the inclined surface.

Formed on the proximal end of the paint tray is a pair of legs designed to elevate the proximal end so that the inclined surface is inclined when the paint tray is disposed horizontally. The shape of the legs and the overall length of the paint tray are sufficient so that the paint tray may be hung vertically when the legs rest on any rung of a standard ladder or stepladder, or may rest horizontally on the ladder shelf. In the preferred embodiment, the distal ends of the legs are sloped inward so that they engage the tread on a flat rung. Also attached to the distal ends is an optional extended lip structure designed to engage the surface of the step or rung. Also in the preferred embodiment, the legs are selectively attached to the paint tray so that the paint tray may be manufactured with the legs removed for compact shipping.

Aligned longitudinally and affixed to the proximal end of the paint tray is a short, rigid handle. The handle is securely affixed to the paint tray thereby preventing unwanted movement of the paint tray when the paint roller is rolled over the inclined surface or when the tray is maneuvered.

DESCRIPTION OF THE PREFERRED EMBODIMENT(S)

Figure 1:
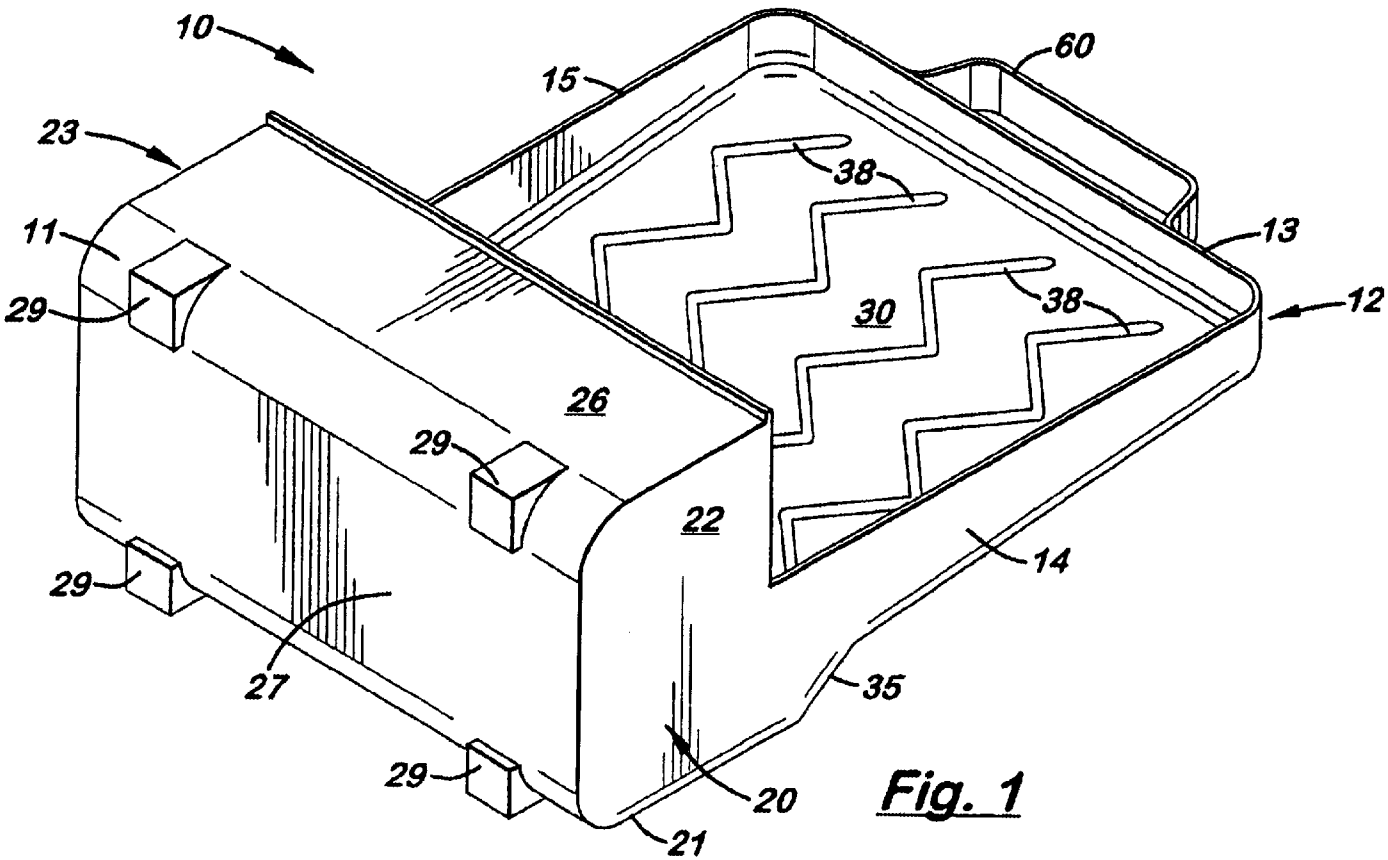
FIG. 1 is a perspective view of the paint tray.

Referring to the accompanying FIGS. 1–9, shown and described is a paint tray 10 that can be used in both horizontal and vertical positions, to apply paint 95 from a roller 90. Formed along the distal end 11 of the tray 10 is a partially enclosed basin 20 that includes an end wall 27, two opposite sidewalls 22, 23, a bottom wall 21, and a top wall 26. The top wall 26 extends rearward, partially covering the bottom wall 21. The inside corners between the end wall 27 and the bottom and top walls 21, 26, respectively, are gently curved thereby enabling a roller 90 to continuously roll and pick up paint 95 located in the corners. Located on the distal end 11 of the tray 10, on the outside surface of the end wall 27, are feet projections 29 that enable of the tray 10 to stand upright in a vertical position on a support surface.

Figure 2:
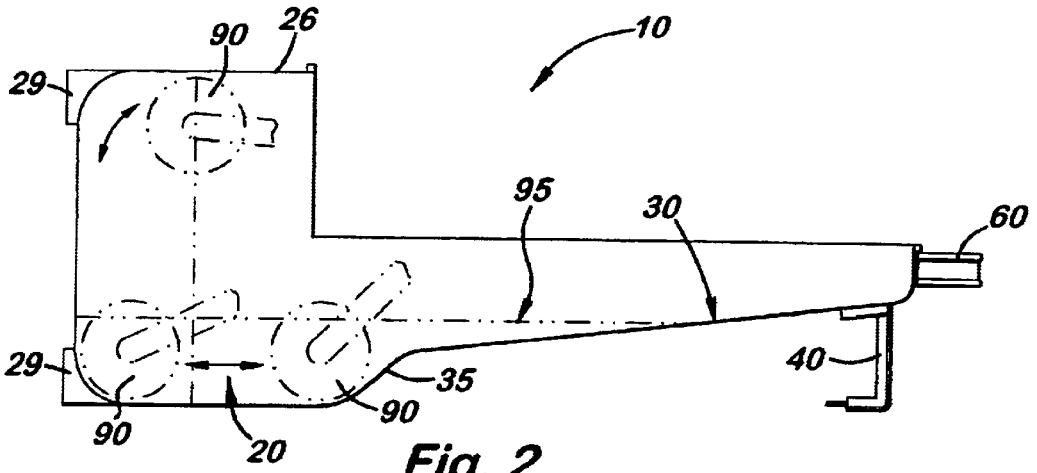
FIG. 2 is a side elevational view of the invention.

Formed inside the paint tray 10 is an inclined surface 30 designed to return excess paint 95 to the basin 20. As shown in FIG. 2, the bottom wall 21 on the basin 20 is offset from the inclined surface 30. A short inclined surface 35 is disposed between the bottom wall 21 and the distal edge of the inclined surface 30. The short inclined surface 35 is offset from the inclined surface 30 so that a larger amount of paint 95 may be placed inside the basin 20 without spilling onto the inclined surface 30. This feature increases the working volume of paint 95 when the paint tray 10 is disposed in a horizontal position. In the preferred embodiment, the basin 20 holds a satisfactory working volume of three pints and three quarts when the paint tray 10 is disposed horizontally and vertically, respectively. The inclined surface 30 includes two opposite sidewalls 14, 15 that are also sufficient in height to contain paint 95 that may overflow from the basin 20 when the paint tray 10 is disposed in the horizontal position.

Figure 3:
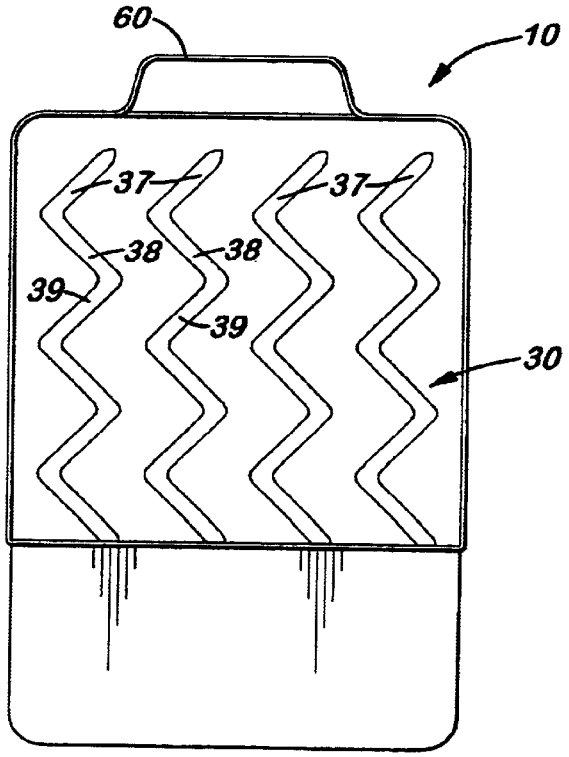
FIG. 3 is a top plan view of the invention.
Figure 4:
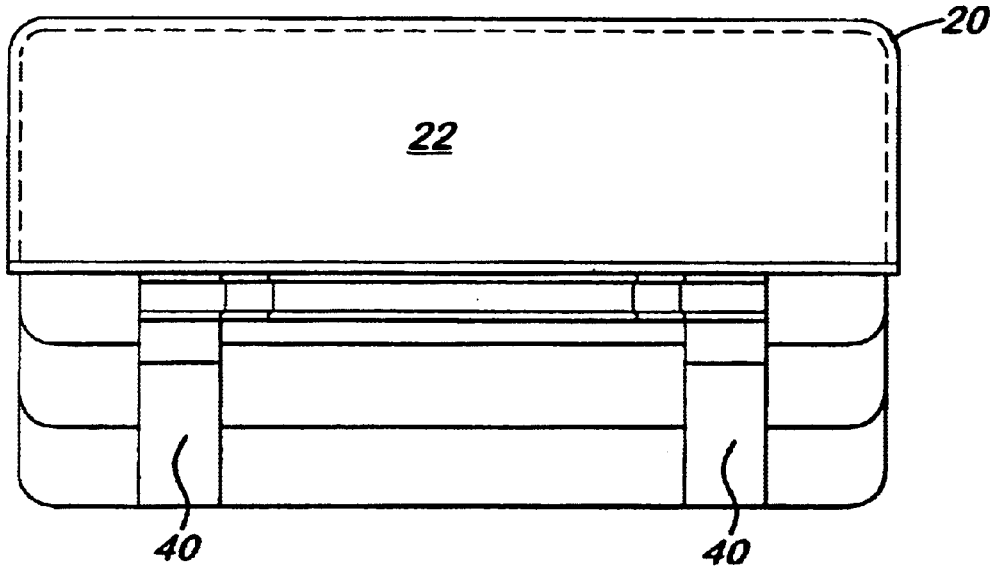
FIG. 4 is a rear elevational view of the invention.
Figure 5:
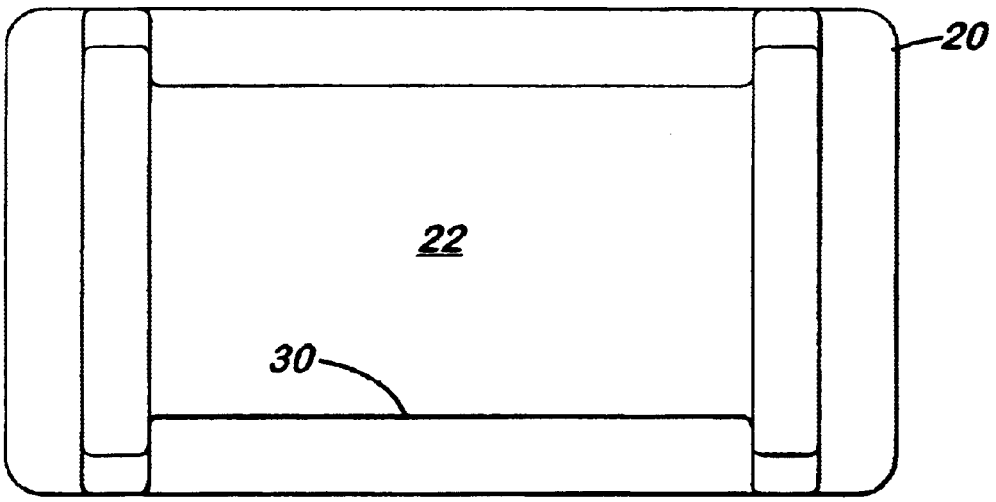
FIG. 5 is a front elevational view of the invention.

As shown in FIG. 3, a plurality of raised contact surface units 37 are formed on the inclined surface 30. The raised contact surface units 37 are longitudinally aligned and equally spaced apart over the inclined surface 30 so that entire surface may be used with a roller. In the preferred embodiment, the raised contact surface units 37 comprise a plurality of raised zigzag-shaped elements 38, 39. The zigzag-shaped elements 38, 39 are joined on their ends to provide a continuous surface over which a roller 90 may be rolled to remove excess paint 95 from the roller 90. The zigzag-shaped elements 38, 39 in adjacent surface units 37 are aligned in a parallel manner so that excessive paint may flow downward over the inclined surface 30 and into the basin 20. Also, adjacent zigzag-shaped elements 38, 39 are aligned so that they do not overlap when the roller is moved downward or upward on the inclined surface 30. This arrangement keeps the roller surface in constant contact with raised contact surface units 37 and assures that the same amount of pressure is applied to the roller 90 when rolled across the inclined surface 30.

The overall length of the paint tray 10 is sufficient so that it may be positioned vertically between rungs 71 or steps 81 on a standard ladder 70 or steps 81 of a stepladder 80, as well as horizontally on the ladder shelf as with traditional paint trays.

Figure 6:
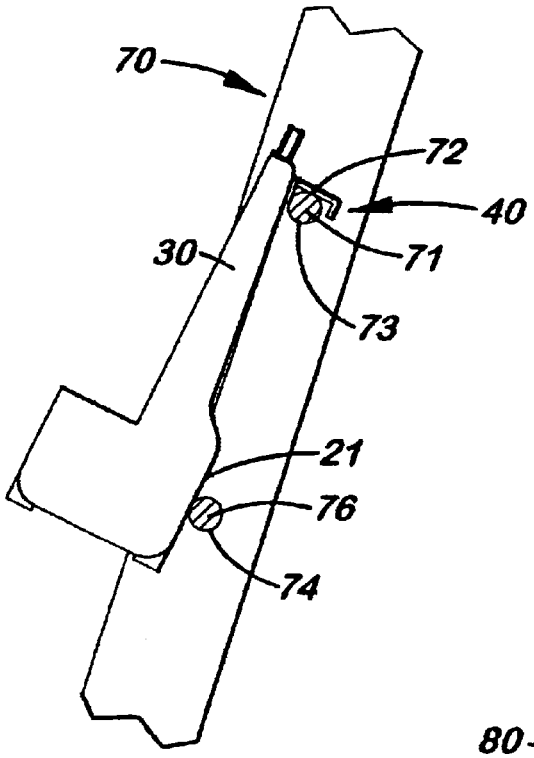
FIG. 6 is a right side elevational view of the invention in use on a ladder.
Figure 7:
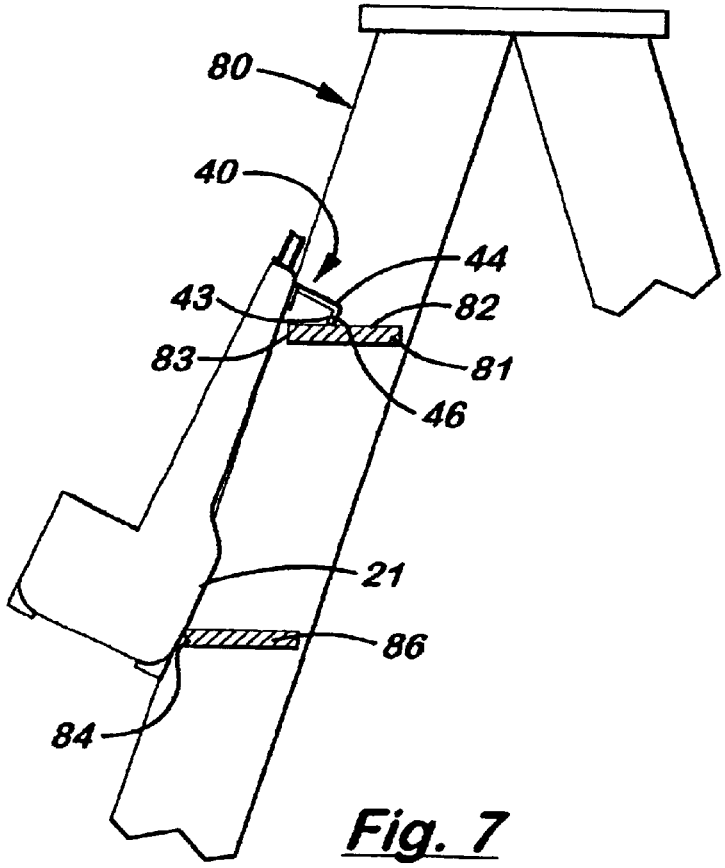
FIG. 7 is a right side elevational view of the invention in use on a stepladder.

Formed near the proximal end 12 of the paint tray 10 is a pair of legs 40 designed to elevate the proximal end 12 so that the inclined surface 30 is disposed at an inclined position when the paint tray 10 is disposed horizontally. The legs 40 are sufficiently shaped and have sufficient length so that the paint tray 10 may be hung vertically when the legs 40 rest on any rung 71 of a standard ladder 70 or stepladder 80 as shown in FIGS. 6 and 7. The legs 40 of the paint tray 10 are sufficiently rigid that they may suspend the weight of a filled paint tray 10 from any point on the leg 40.

Figure 8:
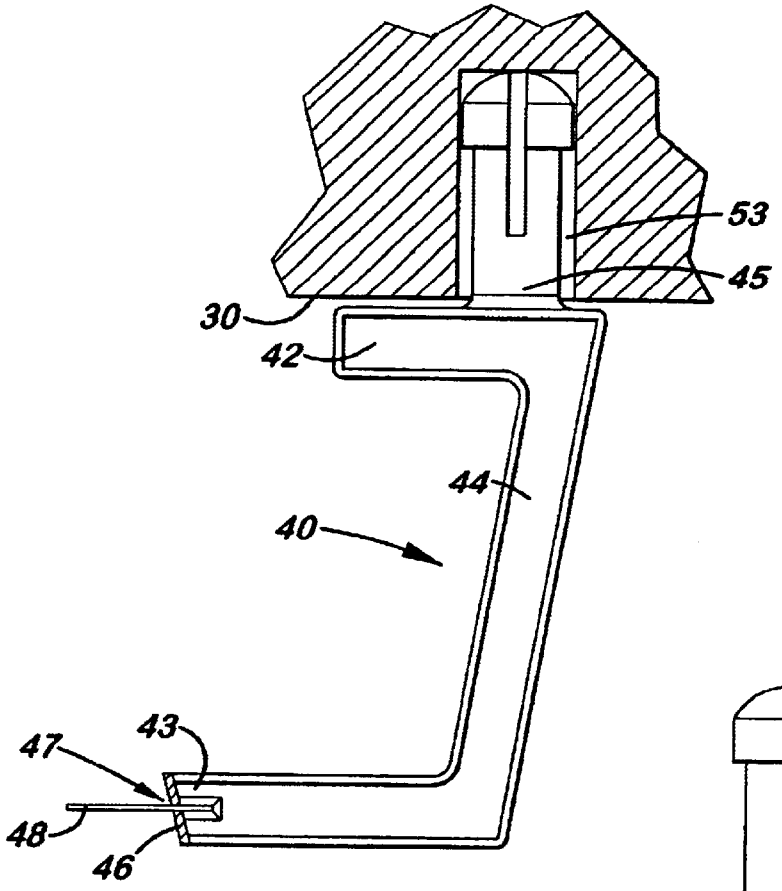
FIG. 8 is a side elevational view of a section of the paint tray with selectively attachable leg connected thereto.
Figure 9:
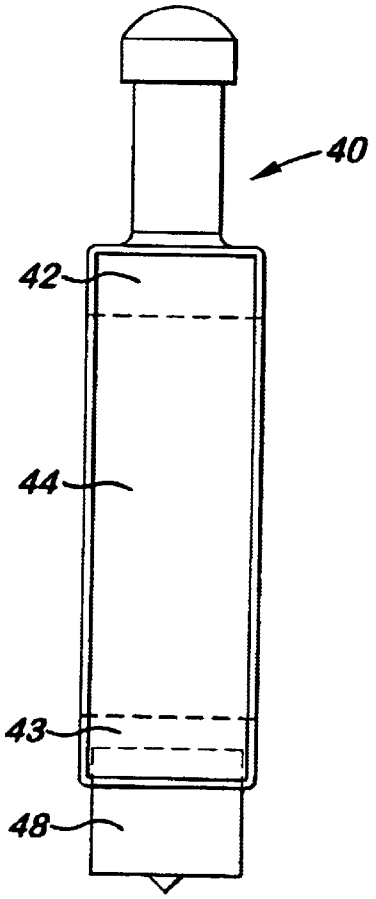
FIG. 9 is an end elevational view of the leg shown in FIG. 8.

In the preferred embodiment, shown in FIGS. 8 and 9, each leg 40 is a C-shaped for the secure resting of the tray 10 on the rung 71 of a ladder 70. Each leg 40 includes an upper horizontal member 42, a lower horizontal member 43, and a diagonal member 44. Formed on the upper horizontal member 42 is a peg 45 which, during assembly is inserted into a bore 53 formed on the bottom surface of the incline surface 30. The distal end surface 46 of the lower horizontal member 43 is sloped rearward approximately 105 degrees from the horizontal axis. Formed transversely on the distal end surface 46 is a slot 47 designed to receive an optional lip structure 48 designed to engage the tread 82 on a step 81, as shown in FIG. 7. The length of the diagonal member 44 on the leg 40 is sufficient to span the thickness of a rung 71. The configuration of the leg 40 is such that it rests on a transapical point 72 of the rung 71 when the paint tray 10 rests against a lateral point 73 of the rung 71, thus allowing the paint tray 10 to rest against two rungs 71, 76 of a ladder 70.

When used on a stepladder 80, the most distal end surface 46 of the leg 40 may rest on the tread 82 of the step 81. This allows the paint tray 10 to be held against the lateral point 83 of the same step 81, and against a lateral point 84 on the lower adjacent step 86, by a friction fit of the distal end surface 46 with the deformity of the safety tread 85 of the step 81. The configuration of the distal end surface 46 is such as to resist the ramping of the distal end surface 46 over the deformities of the tread 82. For either ladder 70 or stepladder 80, the bottom wall 21 of the tray 10 rests against the most lateral point 74, 84 of the next lower rung 76 or step 86, respectively.

Aligned longitudinally and affixed to the front end wall 13 of the paint tray 10 is a handle 60. The handle 60 is sufficiently rigid and of proper orientation and grip design to both prevent undesired motion and control desired motion, by virtue of the user's single hand and wrist action. The handle 60 holds the paint tray 10 in a good position with respect to the user's body for either painting or carrying. When the paint tray 10 is on a ladder 70 or stepladder 80 as shown in FIGS. 6–7, the handle 60 is easily accessible in the space between rungs 71, 76 or steps 81, 86, respectively. From this position the paint tray 10 is so easily relocated that the user may move the paint tray 10 step by step while he climbs the ladder 70 or stepladder 80 with two hands for safety.

In compliance with the statute, the invention described herein has been described in language more or less specific as to structural features. It should be understood, however, that the invention is not limited to the specific features shown, since the means and construction shown, is comprised only of the preferred embodiments for putting the invention into effect. The invention is therefore, claimed in any of its forms or modifications within the legitimate and valid scope of the amended claims, appropriately interpreted in accordance with the doctrine of equivalents.

I claim:

1. A paint tray, comprising:

a. a partially enclosed basin, said basin having an end wall and a top wall, and two side walls;

b. an inclined surface attached to said basin, said inclined surface including two side walls and a front wall;

c. a pair of support legs formed near said front wall of said inclined surface, said pair of support legs having a distal end surface and being of sufficient height to raise said inclined surface so that the level of paint disposed inside said basin does not cover said inclined surface when said paint tray is disposed in the horizontal position;

d. a longitudinally aligned handle rigidly attached to said front surface of said inclined surface, and;

e. a plurality of parallel, raised zigzag-shaped units formed on said inclined surface.

2. The paint tray, as recited in claim 1, wherein each said zigzag-shaped units are disposed on said incline surface so that adjacent zigzag-shaped units do not overlap.

3. A paint tray, comprising:

a. a partially enclosed basin, said basin having an end wall and a top wall, and two side walls;

b. an inclined surface attached to said basin, said inclined surface including two side walls and a front wall;

c. a pair of support legs formed near said front wall of said inclined surface, said pair of support legs having a slanted distal end surface and being of sufficient height to raise said inclined surface so that the level of paint disposed inside said basin does not cover said inclined surface when said paint tray is disposed in the horizontal position and a slanted distal end surface; and, d. a longitudinally aligned handle rigidly attached to said front surface of said inclined surface.

4. The paint tray as recited in claim 3, wherein each said support leg includes an extended lip structure attached to each said distal end surface.

5. The paint tray as recited in claim 3, wherein said support legs removably attached to said inclined surface.

6. A paint tray comprising:

a. a partially enclosed basin, said basin having an end wall and a top wall, and two side walls;

b. an inclined surface attached to said basin, said inclined surface including two side walls and a front wall;

c. a pair of removably attached support legs formed near said front wall of said inclined surface, said pair of support legs having a distal end surface and being of sufficient height to raise said inclined surface so that the level of paint disposed inside said basin does not cover said inclined surface when said paint tray is disposed in the horizontal position;

d. a longitudinally aligned handle rigidly attached to said front surface of said inclined surface, and;

e. a plurality of feet attached to said basin used to hold said paint tray in an upright vertical orientation on a support surface.

7. The paint tray, as recited in claim 6, wherein said basin and said inclined surface are integrally formed and made of plastic.

8. The paint tray, as recited in claim 6, wherein said support legs are removably attached to said inclined surface.

9. A paint tray, comprising:

a. a paint tray body including a partially enclosed basin and an integrally attached inclined surface, said body having a proximal end and a distal end;

b. a pair of support legs removably attached to said inclined surface near said proximal end, said pair of support legs having a distal end surface and being of sufficient height to raise and maintain the level of paint within said basin so that said paint would not flow to the proximal end of said inclined bottom surface when said paint tray is disposed in the horizontal position;

c. a longitudinally aligned handle rigidly attached to said proximal end of said inclined surface; and, d. a plurality of feet attached to said distal end of said paint tray, said feet being used to said paint tray in a upright vertical orientation on a support surface.

10. The paint tray, as recited in claim 9, wherein there are four feet attached to the opposite corners of said distal end of said body.

11. The paint tray, as recited in claim 9, wherein said basin has a sufficient working volume of approximately three quarts of paint when said paint tray is disposed vertically.

12. The paint tray, as recited in claim 9, wherein said inclined surface includes a pair of spaced apart holes formed on its bottom surface and each said leg includes a peg capable of snap-fitting into said holes to selectively connect said legs to said inclined surface.

13. The paint tray, as recited in claim 9, wherein each said pair of legs is C-shaped with a distal end surface.

14. The paint tray, as recited in claim 9, wherein said distal end surface on said leg includes an extending lip member used to engage the surface of a rung on a ladder.

15. The paint tray, as recited in claim 14, wherein said distal end surface is rearward slanted to be rested on the surface of a step.

16. The paint tray, as recited in claim 15, wherein said body, said feet, and said handle are integrally formed one create a complete paint tray unit.

17. The paint tray, as recited in claim 9, further including a plurality of parallel, raised zigzag-shaped units formed on said inclined surface.

18. The paint tray, as recited in claim 17, wherein each said zigzag-shaped units are spaced evenly spaced apart and disposed on said incline surface so that adjacent said zigzag-shaped units do not overlap.

* * * * *